US005311258A

United States Patent [19]

Brewington et al.

[11] Patent Number: 5,311,258

[45] Date of Patent: May 10, 1994

[54] ON-THE-FLY ELECTROSTATIC CLEANING OF SCAVENGELESS DEVELOPMENT ELECTRODE WIRES WITH D.C. BIAS

[75] Inventors: Grace T. Brewington, Fairport; John Buranicz, Cohoes; Richard P. Germain, Webster, all of N.Y.

[73] Assignee: Xerox Corporation, Stamford, Conn.

[21] Appl. No.: 110,460

[22] Filed: Aug. 23, 1993

[51] Int. Cl.[5] ..... G03G 21/00

[52] U.S. Cl. ..... 355/215; 118/647; 118/652; 355/247; 355/261; 355/264; 355/269

[58] Field of Search ..... 355/215, 245, 246, 247, 355/251, 253, 259, 261, 264, 265, 269; 118/647, 652, 653, 656–658

[56] References Cited

U.S. PATENT DOCUMENTS

| | | | |
|---|---|---|---|
| 4,984,019 | 1/1991 | Folkins | 355/215 |
| 5,010,367 | 4/1991 | Hays | 355/247 |
| 5,053,824 | 10/1991 | Schram | 355/259 |
| 5,063,875 | 11/1991 | Folkins et al. | 118/651 |
| 5,124,749 | 6/1992 | Bares | 355/202 |
| 5,134,442 | 7/1992 | Folkins et al. | 355/264 |
| 5,144,370 | 9/1992 | Bares | 355/247 |
| 5,144,371 | 9/1992 | Hays | 355/249 |
| 5,153,648 | 10/1992 | Lioy et al. | 355/247 |
| 5,172,170 | 12/1992 | Hays et al. | 355/259 |
| 5,204,719 | 4/1993 | Bares | 355/247 |
| 5,212,037 | 5/1993 | Julien et al. | 430/120 |

*Primary Examiner*—A. T. Grimley
*Assistant Examiner*—William J. Royer
*Attorney, Agent, or Firm*—Fay, Sharpe, Beall, Fagan, Minnich & McKee

[57] ABSTRACT

An apparatus in which contaminants are on-the-fly removed from an electrode wire positioned between a donor roller and a photoconductive surface. A magnetic roller is adapted to transport developer material to the donor roller. The electrode wire is electrostatically biased with respect to the donor roller to remove contaminants therefrom. The electrostatic wire bias polarity corresponds with the contaminant charge polarity to repel the contaminants from the wire.

21 Claims, 3 Drawing Sheets

ON-THE-FLY ELECTROSTATIC CLEANING OF SCAVENGELESS DEVELOPMENT ELECTRODE WIRES WITH D.C. BIAS

This invention relates generally to the development of electrostatic latent images, and more particularly concerns a scavengeless development system in which an electrostatic bias applied to electrode wires interacts with an electric field on a donor roller to on-the-fly clean the electrode wires.

This invention can be used in the art of electrophotographic printing. Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer material into contact therewith. Two component and single component developer materials are commonly used. A typical two-component developer material comprises magnetic granules having toner particles adhering triboelectrically thereto. A single component developer material typically comprises toner particles. Toner particles are attracted to the latent image forming a toner powder image on the photoconductive surface. The toner powder image is subsequently transferred to a copy sheet. Finally, the toner powder image is heated to permanently fuse it to the copy sheet in image configuration.

Single component development systems use a donor roll for transporting charged toner to the development nip defined by the donor roll and photoconductive surface. The toner is developed on the latent image recorded on the photoconductive member by a combination of mechanical and/or electrical forces. Scavengeless development and jumping development are two types of single component developments. A scavengeless development system uses a donor roll with a plurality of electrode wires closely spaced therefrom in the development zone. An AC voltage is applied to the wires forming a toner cloud in the development zone. The electrostatic field generated by the latent image attracts toner from the toner cloud to develop the latent image. In jumping development, an AC voltage is applied to the donor roll detaching toner from the donor roll and projecting the toner toward the photoconductive member so that the electrostatic fields generated by the latent image attract the toner to develop the latent image. Single component development systems appear to offer advantages of low cost and design simplicity. Two component development systems have been used extensively in many different types of printing machines. A two-component development system usually employs a magnetic brush developer roller for transporting carrier having toner adhering triboelectrically thereto. The electrostatic fields generated by the latent image attract the toner from the carrier so as to develop the latent image. In high speed commercial printing machines, a two-component development system may have lower operating costs than a single component development system. Clearly, two-component development systems and single component development systems each have their own advantages. It has been found that it is desirable to combine these systems to form a hybrid-type of development system incorporating the desirable features of each system. For example, at the Second International Congress on Advances in Non-Impact Printing held in Washington, DC, on Nov. 4, 1984 sponsored by the Society for Photographic Scientists and Engineers, Toshiba described a development system using a donor roll and a magnetic roller. The donor roll and magnetic roller were electrically biased. The magnetic roller transported two-component developer material to a nip defined by the donor roll and magnetic roll. Toner is attracted to the donor roll from the magnetic roll. The donor roll is rotated synchronously with the photoconductive drum. The large difference in potential between the donor roll and latent image recorded on the photoconductive drum causes the toner to jump across the gap from the donor roll to the latent image so as to develop the latent image. Other types of hybrid development systems have also employed electrode wires adjacent the donor in combination with a magnetic roller for transporting developer material. In this type of system, the magnetic roller advances developer material to a position adjacent the donor roller. The donor roller attracts the toner particles from the carrier granules of the developer material. Subsequently, as the donor roller rotates, toner is detached therefrom by the electrical field generated by the electrode wires. The detached toner forms a toner powder cloud in the development zone which develops the latent image recorded on the photoconductive surface. This type of development system is a hybrid scavengeless development system.

Fiber, bead and toner agglomerate contamination and entrapment on the electrode wires in a scavengeless development system is a significant problem. In order to achieve the reliability that will be required for future printing machines, it is necessary to have a virtually failure free development system. Problems that often occur during development with hybrid scavengeless development include ghosting, streaks and wire strobing. Ghosting is a history effect caused by varying amounts of toner throughput within a single print and is manifested on subsequent print areas as density variations. Areas of the donor roll with a high toner throughput produce more density than do areas with low toner throughput. Streaks appear as density non-uniformities that run parallel with the process direction. Wire strobing appears as non-uniform density bands running perpendicular to the process direction. Testing has shown that ghosting and streaking are caused primarily by contamination of the electrode wires. The severity of these problems is dependent upon many factors such as the number of electrode wires, developed mass, test target type, agglomerate carryout performance, etc.

A non-uniform build up of toner on the electrode wires appears to be the main cause of both ghosting and streaks. It has been observed that in areas with high toner throughput, the electrode wires tend to be cleaner than in areas of low throughput. An effective way to remove ghosting and streaks is to manually clean the electrode wires with cotton prior to a print. This is very impractical, and must be done prior to each print. A second, less effective method, depending on developer characteristics, is to clean the donor roll with a reverse bias during cycle out. This method works in most cases to a certain degree, but toner eventually coats the electrode wires and a manual cleaning is yet required, sometimes before a single print is completed. In some cases, cleaning the donor roll does not alleviate ghosting at all.

It is thus clear that it is necessary to reduce and prevent trapped contaminants on the electrode wires in order to enhance developability and to achieve the required high reliability. Various approaches have been devised to clean electrode wires. The following disclosures appear to be relevant: U.S. Pat. No. 4,073,587 to Selwyn, issued Feb. 14, 1978; U.S. Pat. No. 4,516,848 to Moriya, issued May 14, 1985; U.S. Pat. No. 4,568,955 to Hosoya et al., issued Febr. 14, 1986; U.S. Pat. No. 4,868,600 to Hays et al., issued Sep. 19, 1989; U.S. Pat. No. 4,876,575 to Hays, issued Oct. 24, 1989; U.S. Pat. No. 4,984,019 to Folkins, issued Jan. 8, 1991; U.S. Pat. No. 5,124,749 to Bares, issued Jun. 23, 1992; U.S. Pat. No. 5,134,442 to Folkins, et al., issued Jul. 28, 1992; U.S. Pat. No. 5,144,371 to Hays, issued Sep. 1, 1992; U.S. Pat. No. 5,172,170 to Hays, et al. issued Dec. 15, 1992; U.S. Pat. No. 5,204,719 to Bares, issued Apr. 20, 1993; and, U.S. patent application Ser. No. 07/563,026 of Floyd, et al., filed Aug. 3, 1990.

The relevant portions of the foregoing disclosures may be briefly summarized as follows: U.S. patent application Ser. No. 07/563,026 describes a magnetic roll for transporting developer material from a reservoir to a donor roll and electrode wires that are electrically biased to detach toner from the donor rolls so as to form a toner cloud in the development zone. U.S. Pat. No. 4,073,587 describes a corotron wire used to charge a photoconductive surface. The corotron wire is vibrated to prevent the accumulation of contaminants thereon by having a movable pick pluck the wire.

U.S. Pat. No. 4,516,848 discloses a charging wire for charging a drum in an electrostatic copying machine. A tongue piece is mounted on a piezoelectric element. A DC signal is applied to the piezoelectric element to flex the tongue and position it in contact with or closely adjacent to the wire. A high frequency signal is superimposed onto the DC signal to flex and vibrate the tongue piece against the wire to prevent the adhesion of toner powders to the wire.

U.S. Pat. No. 4,568,955 describes a plurality of insulated electrodes located on the surface of a developer roller. The electrodes are connected to an AC and a DC source which generates an alternating electric field between electrodes to cause oscillations of the developer material between the electrodes.

U.S. Pat. No. 4,868,600 discloses a scavengeless development system having electrode wires positioned adjacent a donor roller transporting toner. An AC electric field is applied to the electrode wires to detach the toner from the donor roller forming a toner powder cloud in the development zone.

U.S. Pat. No. 4,876,575 also describes a scavengeless development system having electrode wires positioned adjacent a donor roller transporting toner. An AC electric field is applied to the electrode wires to detach the toner from the donor roller forming a toner powder cloud in the development zone. The frequency of the AC field is between 4 KHZ and 10 KHZ.

U.S. Pat. No. 4,984,019 describes an apparatus including electrode wires positioned closely adjacent the exterior surface of a donor roller and being in the gap between the donor roller and the photoconductive member. The electrode wires are cleaned by vibrating them to remove contaminants therefrom. Vibration is induced in the electrode wires by applying an AC voltage thereon having a suitable frequency.

U.S. Patent No. 5,124,749 describes an apparatus in which a donor roll advances toner to an electrostatic latent image recorded on a photoconductive member. A plurality of electrode wires are positioned in the space between the donor roll and the photoconductive member. The electrode wires are electrically biased to detach the toner from the donor roll so as to form a toner cloud in the space between the electrode wires and photoconductive member. Detached toner from the toner cloud develops the latent image. A damping material is coated on a portion of the electrode wires. The damping material damps vibration of the electrode wires.

U.S. Pat. No. 5,134,442 describes an apparatus for reducing contamination of an electrode member positioned in the space between a surface adapted to have a latent image recorded thereon and a moving donor member. The apparatus includes a plurality of wires positioned prior to the electrode member in the direction of movement of the donor member and closely adjacent to the donor member so that said plurality of wires trap contaminants before they reach the electrode member.

U.S. Pat. No. 5,144,371 describes a scavengeless/non-interactive development system for use in highlight color imaging. The use of dual frequencies for the AC voltages applied between the wires and the donor and donor image receiver of a scavengeless development system allows for greater gap latitude without degradation of line development. Dual frequency refers to the application of an AC voltage at one frequency to the wire electrodes and the simultaneous application of different frequency AC to the donor structure for insuring proper positioning of the toner cloud relative to the imaging surface.

U.S. Pat. No. 5,172,170 describes an apparatus in which a donor roll advances toner to an electrostatic latent image recorded on a photoconductive member. A plurality of electrical conductors are located in grooves in the donor roll. The electrical conductors are spaced from one another and adapted to be electrically biased in the development zone to detach toner from the donor roll so as to form a toner cloud in the development zone.

Lastly, U.S. Pat. No. 5,204,719 describes an apparatus in which an electrostatic latent image recorded on a photoconductive member is developed with toner. A donor roll, spaced from the photoconductive member, transports toner to a development zone adjacent the photoconductive member. An electrode member is positioned in the development zone between the photoconductive member and the donor roll. A DC current is transmitted through the electrode member. A magnetic member interacts with the DC current flowing through the electrode member to substantially electro-magnetically dampen vibrations of the electrode member.

In accordance with one aspect of the present invention, there is provided a method and apparatus for removing contaminants from an electrode member positioned in the space between a surface adapted to have a latent image recorded thereon and a donor member. The apparatus includes means for electrostatically biasing the electrode member negatively with respect to the donor roll, to prevent deposition and facilitate removal of contaminants including negatively charged toner particles therefrom. Means are provided for advancing developer material to the donor member. The advancing means and the electrostatic biasing means are simultaneously operated for on-the-fly electrostatic electrode wire cleaning during developing.

Pursuant to another aspect of the present invention, there is provided an electrophotographic printing machine of the type in which an electrostatic latent image recorded on a photoconductive member is developed to form a visible image thereof. The improvement includes a housing defining a chamber storing a supply of developer material comprising at least carrier and toner. A donor member is spaced from the photoconductive member and adapted to transport toner to a region opposed from the photoconductive member. An electrode member is positioned in the space between the photoconductive member and the donor member. Means are provided for electrostatically biasing the electrode member with an AC voltage having an average or net negative DC component with respect to the donor roll to prevent deposition and facilitate removal of negatively charged contaminants therefrom. A transport member, located in the chamber of said housing, is adapted to advance developer material from the chamber of the housing to the donor member.

Other features of the present invention will become apparent as the following description proceeds and upon reference to the drawings, in which.

While the present invention will be described in connection with the preferred embodiment thereof, it will be understood that it is not intended to limit the invention to this embodiment. On the contrary, it is intended to cover all alternatives, modifications, and equivalents as may be included within the spirit and scope of the invention as defined by the appended claims. Inasmuch as the art of electrophotographic printing is well known, the various processing stations employed in the FIG. 1 printing machine will be shown hereinafter schematically and their operation described briefly with reference thereto.

Figure 1:
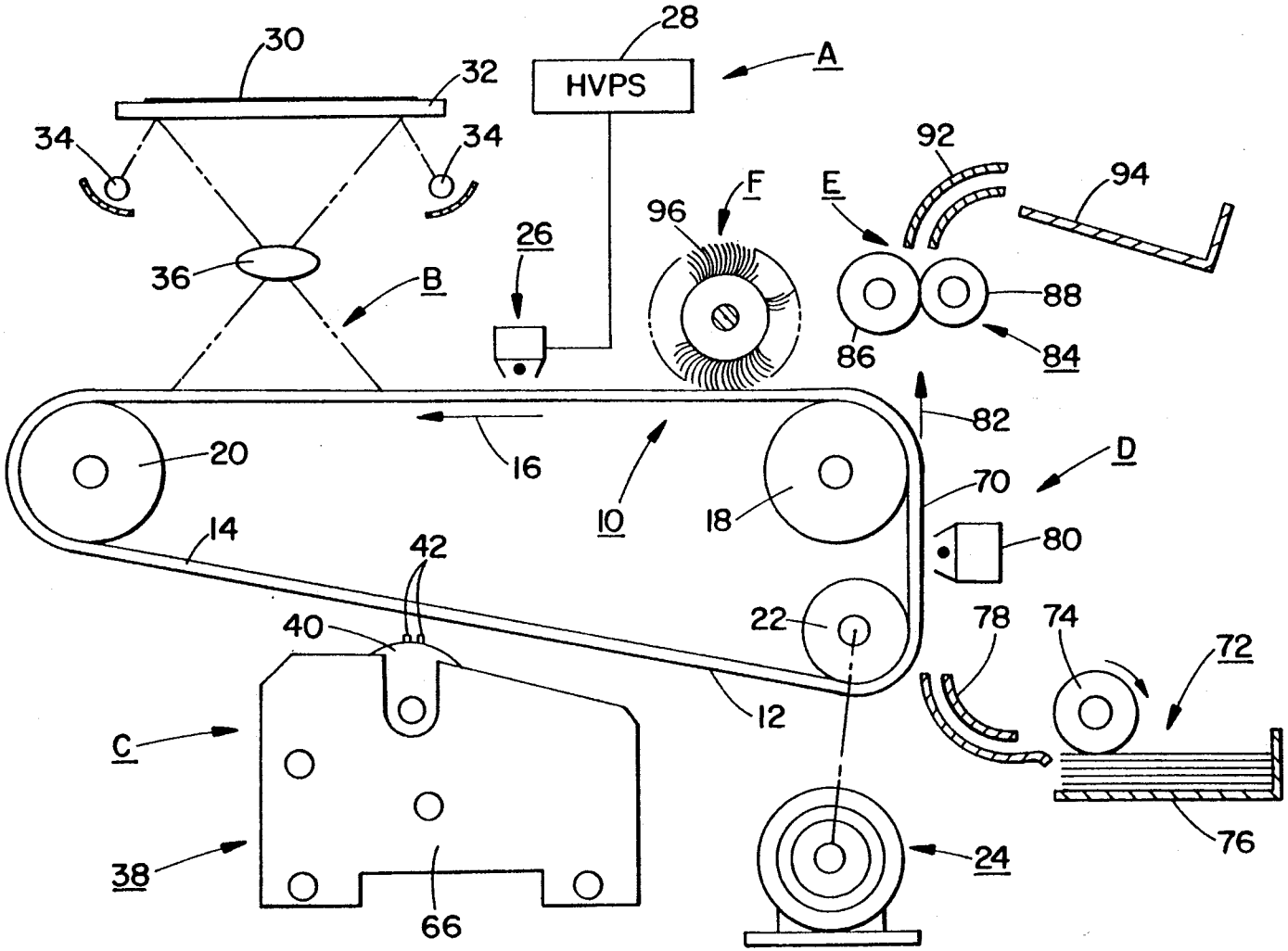
FIG. 1 is a schematic elevational view of an illustrative electrophotographic printing machine incorporating a development apparatus having the features of the present invention therein.

Referring initially to FIG. 1, there is shown an illustrative electrophotographic printing machine incorporating the self-cleaning development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy that is electrically grounded. One skilled in the art will appreciate that any suitable photoconductive belt may be used. Belt 10 moves in the direction of arrow 16 to advance successive portions of photoconductive surface 12 sequentially through the various processing stations disposed throughout the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Belt 10 is maintained in tension by a pair of springs (not shown) resiliently urging tensioning roller 20 against belt 10 with the developed spring force. Stripping roller 18 and tensioning roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26 to charge photoconductive surface of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 that corresponds to the informational areas contained within original document 30.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Preferably, developer unit 38 includes donor roll 40 and a plurality of electrode wires 42. Electrode wires 42 are electrically biased relative to donor roll 40 with an alternating voltage to detach toner therefrom so as to form a toner powder cloud in the gap between the donor roll and the photoconductive surface. The latent image attracts toner particles from the toner powder cloud forming a toner powder image thereon. The donor roll 40 is electrically biased relative to the photoreceptor conductive substrate 14 to control the amount of tonor deposited on the photoreceptor. Donor roll 40 is mounted, at least partially, in the chamber of developer housing 66. The chamber of developer housing 66 stores a supply of developer material. In one embodiment, the developer material is a single component developer material of toner particles, whereas in another embodiment, the developer material includes at least carrier granules and toner particles. In addition to an alternating voltage, electrode wires 42 are electrically biased with an average or net static D.C. voltage to electrostatically negatively bias the wires with respect to the donor roll 40. The electrostatic bias interacts with the electric field of the donor roll 40 to repel the negatively charged toner particles discouraging the accumulation thereof on the wires 42. Various embodiments of the development system will be discussed hereinafter, in greater detail, with reference to FIGS. 2 and 3 inclusive.

With continued reference to FIG. 1, after the electrostatic latent image is developed, belt 10 advances the toner powder image to transfer station D. A copy sheet 70 is advanced to transfer station D by sheet feeding apparatus 72. Preferably, sheet feeding apparatus 72 includes a feed roll 74 contacting the uppermost sheet of stack 76. Sheet feeding apparatus 72 advances sheet 70 into chute 78. Chute 78 directs the advancing sheet of support material into contact with photoconductive surface 12 of belt 10 in a timed sequence so that the toner powder image developed thereon contacts the advancing sheet at transfer station D. Transfer station D includes a corona generating device 80 which sprays ions onto the back side of sheet 70. This attracts the toner powder image from photoconductive surface 12 to sheet 70. After transfer, sheet 70 continues to move in the direction of arrow 82 onto a conveyor (not shown) that advances sheet 70 to fusing station E.

Fusing station E includes a fuser assembly indicated generally by the reference numeral 84, which permanently affixes the transferred powder image to sheet 70. Fuser assembly 84 includes a heated fuser roller 86 and back-up roller 88. Sheet 70 passes between fuser roller 86 and back-up roller 88 with the toner powder image contacting fuser roller 86. In this manner, the toner powder image is permanently affixed to sheet 70. After fusing, sheet 70 advances through chute 92 to catch tray 94 for subsequent removal from the printing by the operator.

After the sheet is separated from photoconductive surface 12 of belt 10, the residual toner particles adhering to photoconductive surface 12 are removed therefrom at cleaning station F. Cleaning station F includes a rotatably mounted fibrous brush 96 in contact with photoconductive surface 12 by the rotation of brush 96 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of electrophotographic printing machines incorporating the electrostatic self-cleaning development apparatus of the present invention therein.

Figure 2:
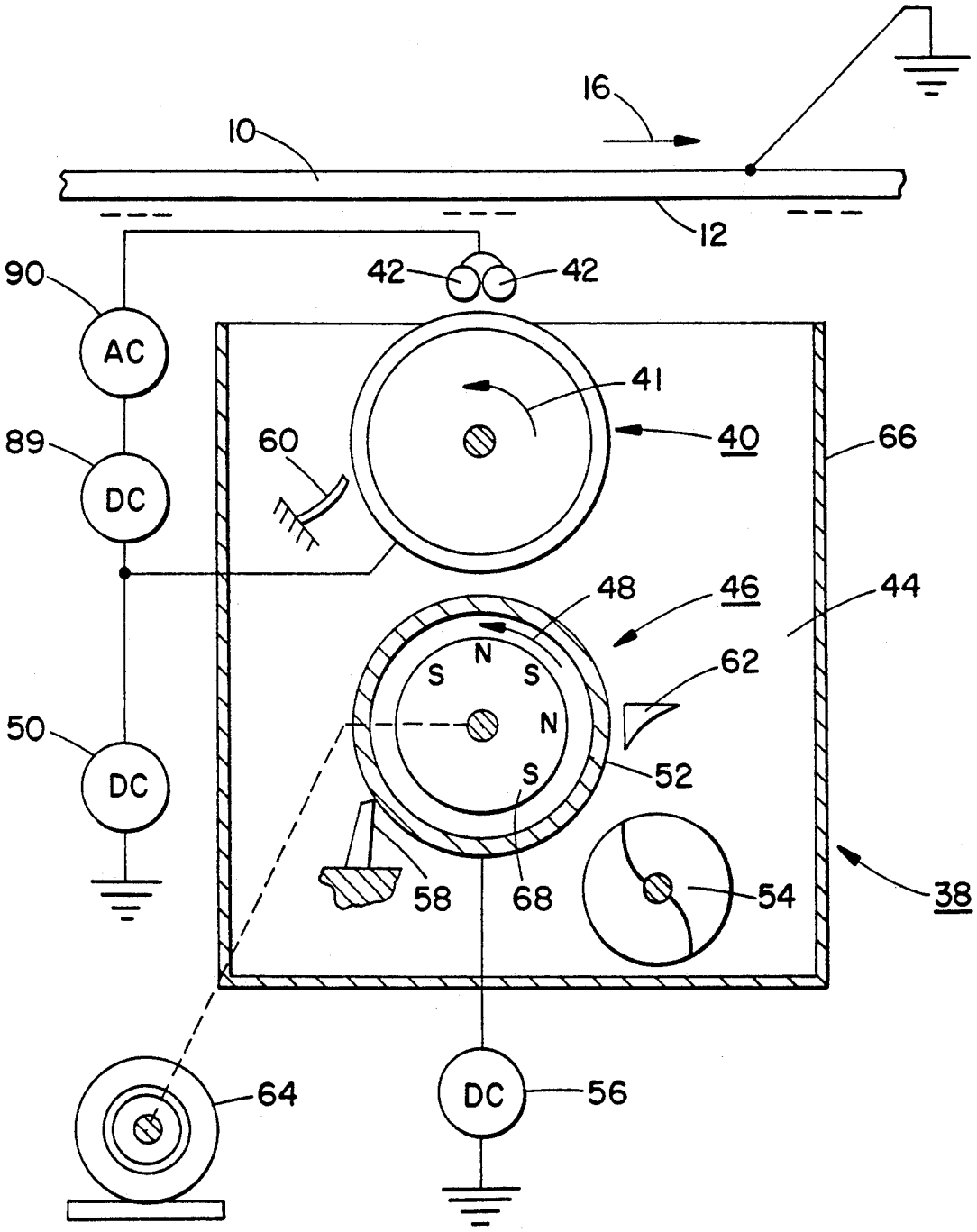
FIG. 2 is a schematic elevational view development apparatus used in the FIG. 1 printing machine; and, FIG. 3 is a detailed circuit diagram illustrating the technique of on-the-fly electrostatic cleaning of scavengeless development electrode wires with a D.C. bias.

Referring now to FIG. 2, there is shown developer unit 38 in greater detail. As shown thereat, developer unit 38 includes a housing 66 defining a chamber 44 for storing a supply of developer material therein. Donor roller 40, electrode wires 42 and magnetic roller 46 are mounted in chamber 44 of housing 66. The donor roller can be rotated in either the 'with' or 'against' direction relative to the direction of motion of belt 10. In FIG. 2, donor roller 40 is shown rotating in the direction of arrow 41, i.e. the against direction. Similarly, the magnetic roller can be rotated in either the 'with' or 'against' direction relative to the direction of motion of donor roller 40. In FIG. 2, magnetic roller 46 is shown rotating in the direction of arrow 48 i.e. the against direction. Donor roller 40 is preferably overcoated with a layer of anodized aluminum. Other possible donor roll overcoatings include various polymers loaded with carbon black or graphite. Electrode wires 42 are disposed in the space between the belt 10 and donor roller 40. Although only two wires are illustrated here for clarity, a plurality of electrode wires are typically used. The electrode wires are normally in intimate contact with donor roller 40. A plurality, i.e. four or five electrode wires extend in a direction substantially parallel to the longitudinal axis of the donor roller. Each electrode wire is made from a thin (i.e. 50 to 100$\mu$ diameter) stainless steel strand. The extremities of the wires are supported by the tops of end bearing blocks which also support the donor roller for rotation. The wire extremities are attached so that they are tangent to and in contact with the surface of the donor roller. Mounting the wires in such a manner makes them insensitive to roll runout due to their self-spacing.

As illustrated in FIG. 2, an alternating electrical bias is applied to the electrode wires by an AC voltage source 90. In operation, the applied AC establishes an alternating electrostatic field between the wires and the donor roller which is effective in detaching toner from the surface of the donor roller and forming a toner cloud about the wires, the height of the cloud being such as not to be substantially in contact with the belt 10. The applied A.C. is a biased waveform having a net DC component offset 89 causing the wire 42 to be more negatively charged on average than the donor roller. The bias keeps the electrode wires relatively free of negatively charged toner effecting an electrostatic cleaning thereof. As illustrated in the FIGURE, the AC voltage source 90 generates a balanced waveform with an average voltage of zero. The D.C. bias is provided by the DC voltage source 89 whereby the AC source 90 "rides" an average D.C. bias according to the connection illustrated. Alternatively, the AC voltage source 90 itself may generate an unbalanced waveform with a non-zero average voltage. The non-zero average voltage alone or in combination with the DC source 58 is equivalent to the arrangement illustrated in FIG. 2.

An advantage of the present invention is that the electrode wires are electrostatically cleaned during application of the A.C. forming the toner cloud during the development operation. That is, the electrode wires are electrostatically cleaned on-the-fly, rather than in an off-line process as in the past.

During operation, the magnitude of the AC voltage is relatively low and is on the order of 200 to 600 volts peak at a frequency ranging from about 3 kHz to about 18 kHz. A DC bias supply 50 which applies approximately −350 volts to donor roller 40 establishes an electrostatic field between photoconductive surface 12 of belt 10 and donor roller 40 for attracting the detached toner particles from the cloud surrounding the wires to the latent image recorded on the photoconductive surface. The use of a dielectric coating on either the electrode wires or donor roller prevents shorting of the applied AC voltage. A cleaning blade 60 strips all of the toner from donor roller 40 after development so that magnetic roller 46 meters fresh toner to clean donor roller. Magnetic roller 46 meters a constant quantity of toner having a substantially constant charge on to donor roller 40. This insures that the donor roller provides a constant amount of toner having a substantially constant charge in the development gap. In lieu of using a cleaning blade, the combination of donor roller spacing, i.e. spacing between the donor roller and the magnetic roller, the compressed pile height of the developer material on the magnetic roller, and the magnetic properties of the magnetic roller in conjunction with the use of a conductive, magnetic developer material achieves the deposition of a constant quantity of toner having a substantially constant charge on the donor roller. During operation, DC bias supply 56 applies approximately 31 75 volts D.C. to magnetic roller 46 relative to donor roller 40 to establish an electrostatic field between magnetic roller 46 and donor roller 40 which causes toner particles to be attracted from the magnetic roller to the donor roller. Metering blade 62 is positioned closely adjacent to magnetic roller 46 to maintain the compressed pile height of the developer material on magnetic roller 46 at the desired level. Magnetic roller 46 includes a non-magnetic tubular member or sleeve 52 made preferably from aluminum and having the exterior circumferential surface thereof roughened. An elongated multiple magnet 68 is positioned interiorly of and spaced from the tubular member. The magnet is mounted stationarily. The tubular member is mounted on suitable bearings and is coupled to motor 64 for rotation thereby. The tubular member 52 rotates in the direction of arrow 48 to advance the developer material adhering thereto into the nip defined by donor roller 40 and magnetic roller 46. Toner particles are attracted from the carrier granules on the magnetic roller to the donor roller. Scraper blade 58 moves denuded carrier granules on extraneous developer material from the surface of tubular member 52.

With continued reference to FIG. 2, augers, indicated generally by the reference numeral 54, are located in chamber 44 of housing 66. Augers 54 are mounted rotatably in chamber 44 to mix and transport developer material. The augers have blades extending spirally outwardly from a shaft. The blades are designed to advance the developer material in the axial direction substantially parallel to the longitudinal axis of the shaft.

As successive electrostatic latent images are developed, the toner particles within the developer material are depleted. A toner dispenser (not shown) stores a supply of toner particles. The toner dispenser is in communication with chamber 44 of housing 66. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge. The developer material in the chamber of the developer housing is magnetic and may be electrically conductive. By way of example, the carrier granules include a ferromagnetic core with a non-continuous layer of resinous material. The toner particles are made from a resinous material, such as a vinyl polymer, mixed with a coloring material, such as carbon black. The developer material comprise from about 95% to about 99% by weight of carrier and from 5% to about 1% by weight of toner. However, one skilled in the art will recognize that any suitable developer material having at least carrier granules and toner particles may be used.

Figure 3:
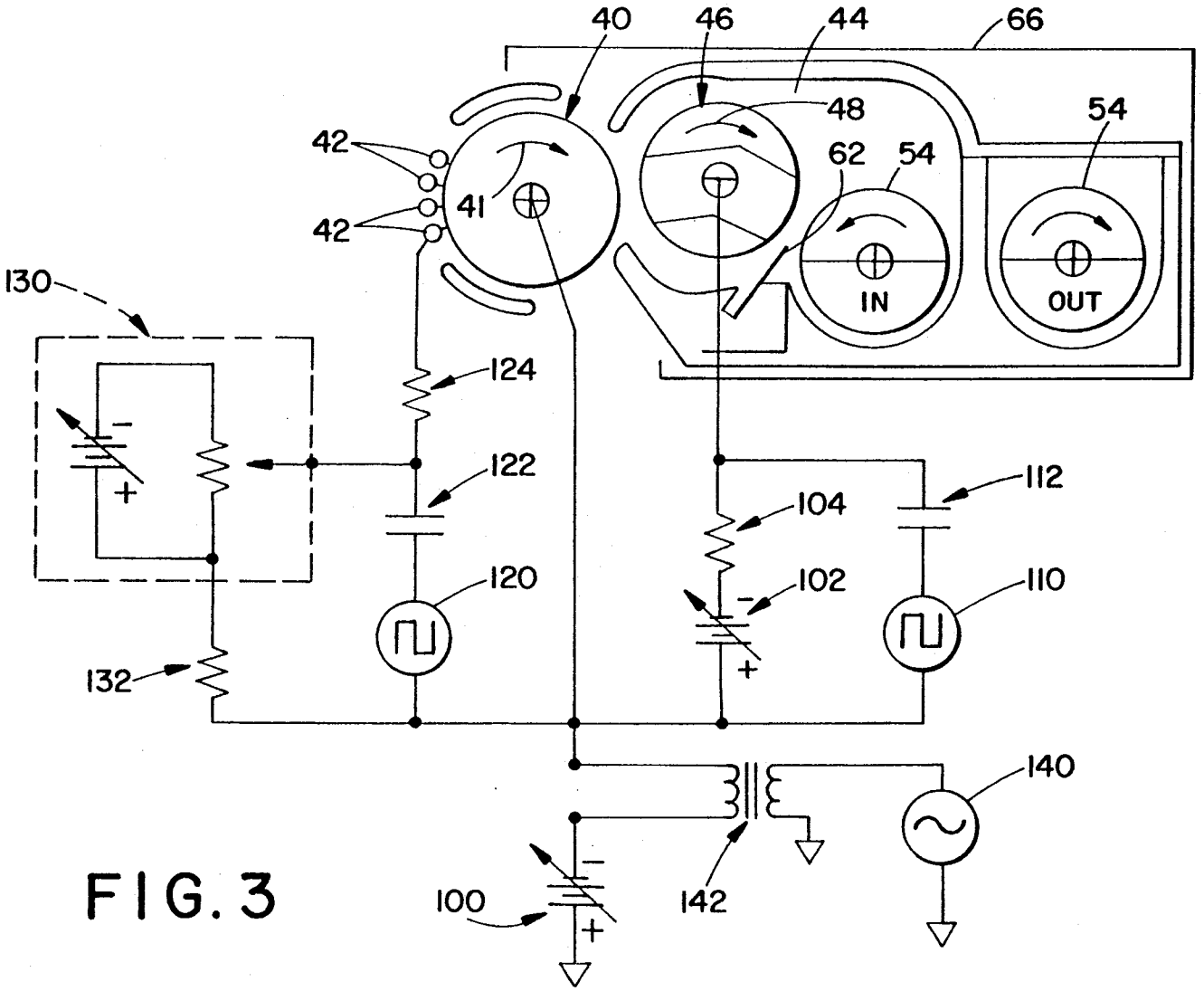

Turning now to FIG. 3, there is shown the circuitry for electrostatic cleaning of electrode wires 42 using a D.C. bias according to the preferred embodiment. The DC voltages sources 50, 56 shown in FIG. 2 are illustrated here as being preferably a single first DC voltage source 100 with a polarity as indicated. As discussed above with reference to the development apparatus in general, the magnetic roller 46 is biased to be somewhat more negative than the donor roller 40. As shown, a second DC voltage source 102 connects the magnetic roller 46 to the first DC voltage source 100 through a current limiting resistor 104. Preferably, the first DC voltage source 100 is set to −350 volts DC while the second DC voltage source 102 is set to −75 volts DC resulting in a bias on the donor roller 40 of −350 volts DC and a bias on the magnetic roller 46 of −425 volts DC. A first square wave AC voltage source 110 is connected to the magnetic roller 46 through a coupling capacitor 112 to influence a uniform deposit of development material onto the magnetic roller 46 from the chamber 44. Using a standard toner with the above preferable voltage settings, the magnetic roller 46 meters a constant quantity of toner having a substantially constant toner layer space charge of approximately −50 V to −75 V onto the donor roller 40.

A feature of the present invention is to provide the electrode wires 42 with an average electrostatic DC negative voltage offset with respect to the donor roller bias equal to the toner layer space charge level. For efficient electrostatic cleaning of the electrode wires 42, the average DC negative voltage offset has been found to be approximately 25–150 volts and preferably about 50 volts. That is, for negatively charged contaminants, the electrode wires should be 50 volts more negative than the donor roller bias and equal to the toner layer space charge in the development gap. Of course, for positively charged contaminants, the electrode wires should be 50 volts more positive than the donor roller bias and equal to the toner layer space charge in the development gap.

A second square wave AC voltage source 120 is capacitively coupled to the electrode wires 42 through a coupling capacitor 122 and a current limiting resistor 124. As indicated above, the applied AC from the second square wave AC voltage source 120 establishes an alternating electrostatic field between the wires 42 and the donor roller 40 which is effective in detaching toner from the surface of the donor roller and forming a toner cloud about the wires 42 in the development gap. To effect an electrostatic cleaning of the electrode wires 42, a third DC voltage source 130 is connected in parallel with the second square wave AC voltage source 120 through a current limiting resistor 132. Using a typical toner with the first DC voltage source 100 set at −350 volts DC and the second DC voltage source 102 set at −75 volts DC results in a toner layer space charge in the development gap of approximately −50 volts DC to −75 volts DC, the third DC voltage source 130 is set to between −50 volts DC and −75 volts DC to effect a difference in potential between the wires 42 and the donor roller 40 of approximately 50 to 75 volts. This has been found ti effectively eliminate the accumulation of toner build-up on the wires 42 which is a major cause of both ghosting and streaks in the developed image. Although two power supplies 120, 130 are illustrated, it is possible to provide a single AC voltage which includes a biased waveform having a net DC component offset causing the electrode wires to be more negatively charged on average than the donor roller.

Another embodiment for donor roller cleaning will now be described with continued reference to FIG. 3. The donor roller 40 is substantially cleaned of toner between print cycles or off-line by adjusting the DC bias on variable supplies 102 and/or 100 such that toner particles are electrostatically driven to move from the donor roller surface back onto the carrier granules. During this off-line donor cleaning cycle, the small amount of toner remaining on the donor roller is typically of opposite polarity from the toner used for development of the latent image. The space charge of this toner on the donor roller during this off-line donor cleaning cycle is positive. Corresponding with the initiation of the donor cleaning cycle in which the toner space charge is positive, the DC bias 130 applied to the electrodes 42 is changed to approximately positive 20 to 150 volts relative to the donor roller to prevent toner build-up on the wires. During the application of the DC bias to the electrode wires the electrostatic attraction of the electrode to the donor roller is reduced and the electrode vibration is thereby reduced.

Lastly with reference to FIG. 3, a first sinusoidal wave AC voltage source 140 is connected between the donor roller 40 and the first DC voltage source 100 through a transformer 142. This voltage source may be included as desired to control the developability of lines in the degree of interaction between the toner and the receiver as taught in U.S. Pat. No. 5,010,367 to Hays.

In recapitulation, it is evident that the development system of the present invention includes an electrostatic negative DC offset on the electrode wires positioned closely adjacent the exterior surface of a more positively biased donor roll in the gap defining the development zone between the donor roll and the photoconductive belt. An electrostatic field is generated between the electrode wires and the donor roll whereby the electrostatic field discourages build-up of toner particles on the development wires. An average negative DC voltage is applied to the electrode wires to generate an electrostatic field thereon. The electrostatic field in combination with the charge on the donor roller substantially reduces the build-up of negatively charged toner on the electrode wires.

While this invention has been described in terms of negative toner, it is intended to be understood that for positively charged toner or other contaminants, one would merely change the polarity of the DC bias on the electrode wires 130 to correspond with the positive polarity of the surface potential of the toner layer to effect electrode wire cleaning according to this invention.

It is, therefore, apparent that there has been provided in accordance with the present invention, a development system that fully satisfies the advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

Having thus described the invention, we now claim:

1. An apparatus for forming images on an image receiving surface with developer, said apparatus comprising:

a supply of marking particles;

transport means for transporting marking particles from said supply to an area adjacent said image receiving surface;

forming means for forming transported marking particles into a cloud of marking particles, the forming means including a wire electrode structure disposed between said transport means and said image receiving surface, the wire electrode structure being connected to a first voltage source for applying an alternating voltage potential to said wire electrode structure with respect to said transport means; and, offset means for creating an average electrostatic voltage potential on said wire electrode structure with respect to said transport means by applying an offsetting voltage signal to at least one of said wire electrode structure and said first voltage source.

2. The apparatus according to claim 1 wherein:

said first voltage source includes means for applying an AC square wave voltage signal to said wire electrode structure; and, said offset means includes means for applying an offsetting average negative voltage signal to at least one of said wire electrode structure and said first voltage source.

3. The apparatus according to claim 1 wherein:

said first voltage source includes means for applying an AC square wave voltage signal to said wire electrode structure; and, said offset means includes means for applying an offsetting average positive voltage signal to at least one of said wire electrode structure and said first voltage source.

4. The apparatus according to claim 2 wherein:

said transport means comprises a donor roll for transporting said marking particles from said supply to said area adjacent said image receiving surface, the transported particles accumulating a negative space charge voltage potential; and, said offset means includes means for applying said offsetting average negative voltage signal to negatively bias said wire electrode structure with respect to the donor roll.

5. The apparatus according to claim 2 wherein:

said transport means comprises a donor roll for transporting said marking particles from said supply to said area adjacent said image receiving surface, the transported particles accumulating a negative space charge voltage potential; and, said offset means includes means for applying said offsetting average positive voltage signal to positively bias said wire electrode structure with respect to the donor roll.

6. A method of electrostatic nip wire cleaning while developing a latent image on a surface in an imaging apparatus, the method comprising:

providing a housing defining a chamber storing a supply of toner therein;

providing a donor member spaced from said surface and being adapted to transport toner to a region opposed from said surface;

providing a nip wire positioned in the space between said surface and said donor member, said nip wire being closely spaced from said donor member;

electrically biasing said nip wire with an AC voltage signal having a negative electrostatic DC voltage component to detach toner from said donor member while repelling said detached toner from said nip wire so as to form a toner cloud in the space between nip wire and said surface with said detached toner from the toner cloud developing the latent image.

7. The method according to claim 6 wherein said electrically biasing step includes the step of electrically biasing said nip wire with an AC square wave voltage signal having a negative DC voltage component with respect to the donor member.

8. The method according to claim 6 wherein said electrically biasing step includes the steps of:

providing an AC square wave voltage source connected to said nip wire, the AC square wave voltage source generating an AC square wave voltage signal;

providing a DC voltage source connected to said nip wire, the DC voltage source generating a negative DC voltage signal; and, electrically biasing said nip wire with a combination of said AC square wave voltage signal and said negative DC voltage signal with respect to the donor member.

9. The method according to claim 8 wherein said electrically biasing step includes the step of simultaneously applying said AC square wave voltage signal and said negative DC voltage signal to said nip wire.

10. The method according to claim 9 wherein said electrically biasing step includes the step of simultaneously continuously applying said AC square wave voltage signal and said negative DC voltage signal to said nip wire while developing said latent image on said surface.

11. A method of electrode nip wire biasing to minimize the buildup of toner particles thereon for use in a hybrid scavengeless development apparatus developing a latent image recorded on a surface including a housing defining a chamber storing a supply of the toner therein, a donor member spaced from said surface and being adapted to transport toner to a region opposed from said surface, and an electrode nip wire positioned in the space between said surface and said donor member, the method comprising the steps of:

biasing said donor member with a first voltage signal to attract toner from the chamber to the donor member; and, biasing said electrode nip wire with a second electrostatic voltage signal to simultaneously i) detach toner from said donor member so as to form a toner cloud in the space between said electrode nip wire and said surface with detached toner from the toner cloud developing said latent image; and, ii) repel toner from the electrode nip wire.

12. The method according to claim 11 wherein said electrode nip wire biasing step includes electrically biasing said electrode nip wire with said second voltage signal including an AC voltage signal having an average negative DC voltage component with respect to the donor member to simultaneously i) detach said toner from said donor member with said AC voltage signal so as to form said toner cloud; and, ii) repel toner from the electrode nip wire with said average negative DC voltage component.

13. A method of electrode nip wire biasing to minimize the buildup of toner particles thereon for use in a hybrid scavengeless development apparatus developing a latent image recorded on a surface including a housing defining a chamber storing a supply of the toner therein, a donor member spaced from said surface and being adapted to transport toner to a region opposed from said surface, and an electrode nip wire positioned in the space between said surface and said donor member, the method comprising the steps of:

biasing said donor member with a first voltage signal to attract toner from the chamber to the donor member; and, biasing said electrode nip wire with a second electrostatic voltage signal to effect both i) detachment of toner from said donor member so as to form a toner cloud in the space between said electrode nip wire and said surface with detached toner from the toner cloud developing said latent image; and, ii) repulsion of toner from the electrode nip wire.

14. The method according to claim 13 wherein said electrode nip wire biasing step includes electrically biasing said electrode nip wire with said second voltage signal including an AC voltage signal having an average negative DC voltage component to simultaneously i) detach said toner from said donor member with said AC voltage signal so as to form said toner cloud; and, ii) repel toner from the electrode nip wire with said average negative DC voltage component.

15. An electrostatic cleaning apparatus for use with an electrode structure of an image developer forming images on an image receiving surface with developer and including a supply of marking particles, a transport mechanism for transporting marking particles from said supply to an area adjacent the image receiving surface, and said electrode structure forming transported marking particles into a cloud of marking particles, the electrostatic cleaning apparatus comprising:

a first voltage source connected to the electrode structure applying an alternating voltage potential to said electrode structure with respect to said transport mechanism; and, offset means for creating an average electrostatic voltage potential on said electrode structure with respect to said transport mechanism by applying an offsetting voltage signal to at least one of said electrode structure and said first voltage source.

16. A method of electrostatic nip wire vibration dampening while developing a latent image on a surface in an imaging apparatus including a housing defining a chamber storing a supply of toner therein, and a donor member spaced from said surface and being adapted to transport toner to a region opposed from said surface, the method comprising:

providing a nip wire positioned in the space between said surface and said donor member, said nip wire being closely spaced from said donor member; and, electrostatically biasing said nip wire with respect to said donor member using an alternating voltage signal having an average electrostatic component simultaneously detaching toner from said donor member while dampening vibration of said nip wire.

17. The method of electrostatic nip wire vibration dampening according to claim 16 further comprising the step of electrostatically biasing said nip wire with respect to said donor member using said alternating voltage signal having said average electrostatic component simultaneously detaching toner from said donor member while dampening vibration of said nip wire and repelling said detached toner from said nip wire so as to form a toner cloud in the space between said nip wire and said surface with said detached toner from the toner cloud developing the latent image.

18. A method of electrostatic nip wire and donor member cleaning in an imaging apparatus during development cycles developing a latent image on a surface and between the development cycles, the method comprising the steps of:

providing a housing defining a chamber storing a supply of toner therein;

providing a first member adapted to transport toner from said chamber;

providing a donor member spaced from said surface and spaced from said first member and being adapted to transport toner from said first member to a region opposed from said surface;

providing a nip wire positioned in the space between said surface and said donor member, said nip wire being closely spaced from said donor member;

during said development cycles:

electrically biasing said nip wire with an alternating voltage signal having an average electrostatic voltage component with respect to said donor member to detach toner from said donor member while repelling said detached toner from said nip wire forming a toner cloud in the space between said nip wire and said surface with said detached toner from the toner cloud developing the latent image; and, between said development cycles:

electrically biasing said donor member with a voltage signal having an average electrostatic voltage component with respect to said first member to detach toner from said donor member.

19. The method according to claim 18 wherein said electrically biasing step between said development cycles includes the step of electrically biasing said nip wire with a voltage signal having an average electrostatic voltage component with respect to said donor member to repel toner from said nip wire.

20. The method according to claim 19 further comprising the steps of:

during said development cycles:

electrically biasing said nip wire with said alternating voltage signal having an average negative electrostatic voltage component with respect to said donor member; and, between said development cycles:

electrically biasing said donor member with said voltage signal having an average positive electrostatic voltage component with respect to said first member to detach toner from said donor member.

21. The method according to claim 19 wherein said electrically biasing step between said development cycles includes the step of electrically biasing said nip wire with said voltage signal having an average positive electrostatic voltage component with respect to said donor member to detach toner from said nip wire.

* * * * *